US012680277B2

(12) United States Patent
Liu et al.

(10) Patent No.: US 12,680,277 B2
(45) Date of Patent: Jul. 14, 2026

(54) METHOD OF AUTOMATIC DELAY COMPENSATION FOR IMPLEMENT CONTROL WITH WORK MACHINE

(71) Applicant: Deere & Company, Moline, IL (US)

(72) Inventors: Qiang R. Liu, Urbandale, IA (US); Ashish Barsu Patil, West Des Moines, IA (US)

(73) Assignee: Deere & Company, Moline, IL (US)

( * ) Notice: Subject to any disclaimer, the term of this patent is extended or adjusted under 35 U.S.C. 154(b) by 135 days.

(21) Appl. No.: 18/434,430

(22) Filed: Feb. 6, 2024

(65) Prior Publication Data

US 2025/0250777 A1 Aug. 7, 2025

(51) Int. Cl.
*E02F 9/26* (2006.01)
*E02F 9/20* (2006.01)
*E02F 9/22* (2006.01)

(52) U.S. Cl.
CPC ..... *E02F 9/265* (2013.01); *E02F 9/2037* (2013.01); *E02F 9/2203* (2013.01)

(58) Field of Classification Search
CPC ..... E02F 9/265; E02F 9/2037; E02F 9/2203
USPC ..... 701/50
See application file for complete search history.

(56) References Cited

U.S. PATENT DOCUMENTS 8,948,980 B2 * 2/2015 Garner ..... A01C 21/005 111/80
9,719,217 B2 8/2017 Fritz et al.
9,896,810 B2 2/2018 Berning et al.
9,915,041 B2 3/2018 Berning et al.
9,955,625 B2 * 5/2018 Baurer ..... H04L 5/0019
11,340,092 B2 5/2022 Colosky et al.
11,821,169 B2 * 11/2023 Peterson ..... E02F 9/265
11,845,449 B2 12/2023 Vandike et al.
2004/0193348 A1 9/2004 Gray et al.
2013/0124055 A1 * 5/2013 Baurer ..... A01C 7/102 701/461
2013/0341159 A1 * 12/2013 Lopes ..... G05D 7/0605 198/507
2018/0242514 A1 * 8/2018 Baurer ..... H04L 5/0048
(Continued)

FOREIGN PATENT DOCUMENTS

WO 2023159160 A1 8/2023

*Primary Examiner* — Anshul Sood
*Assistant Examiner* — Wenyuan Yang
(74) *Attorney, Agent, or Firm* — Gary L. Montle; Lucian Wayne Beavers; Patterson Intellectual Property Law, PC

(57) ABSTRACT

Systems and methods are provided for automated self-correction of lookahead delay for working intermissions of at least one work implement associated with a work machine. During traverse by the work machine of a work area, one or more working conditions are determined and command generated to at least one actuator corresponding to a working intermission for an associated work implement or component thereof, wherein the generated command accounts for an estimated delay between initiation of the command and execution of at least part of the working intermission. An error value is ascertained based on a determined actual delay with respect to the estimated delay, and a modified delay is stored based on the ascertained error value as the estimated delay for subsequent working intermissions at least with respect to the determined one or more working conditions.

20 Claims, 8 Drawing Sheets

(56) References Cited

U.S. PATENT DOCUMENTS

| | | | | |
|---|---|---|---|---|
| 2021/0208953 | A1* | 7/2021 | Vasileiadis | G06F 9/4881 |
| 2022/0195693 | A1* | 6/2022 | Kalantar | E02F 3/841 |
| 2023/0000007 | A1 | 1/2023 | Sawlaw et al. | |
| 2023/0263083 | A1 | 8/2023 | Rains et al. | |
| 2023/0320254 | A1 | 10/2023 | Vandike et al. | |
| 2023/0389462 | A1 | 12/2023 | Liu et al. | |

* cited by examiner

METHOD OF AUTOMATIC DELAY COMPENSATION FOR IMPLEMENT CONTROL WITH WORK MACHINE

FIELD OF THE DISCLOSURE

The present disclosure relates generally to work machines having associated work implements, for example towed by or otherwise associated with self-propelled work vehicles, and more particularly to a method and system for automatic delay compensation for control of such work implements with respect to desired working intermissions in a work area.

BACKGROUND

A work area may for example represent a field for growing a crop or other vegetation, or another type of area including terrain to be worked by an implement or other tool associated with a work machine. In the context of a field as the work area, for example, the work machine may need to traverse the entire work area or a portion thereof to plant a crop, to treat a crop, to harvest a crop, or to perform another task associated with the crop or vegetation, to name non-limiting examples. Within such a work area, or comprising certain exterior boundaries to such a work area, may be portions such as waterways that should not be worked by the work machine, and wherein a working intermission is desired. A working intermission may preferably be limited closely to these portions, at least to avoid overruns or underruns with respect to the terrain to be worked.

Practically speaking, mechanical or electrical delays may be common if not inherent between a command and the completion of the action for implementing a working intermission. Accordingly, conventional systems and methods are known which use look ahead time or distance to compensate the mechanical or electrical delays.

However, conventional systems and methods typically rely on manual input from machine operators to find and set the look ahead time or distance correctly, which is not easy to measure and may vary with specific machine setup or current work conditions, undesirably resulting in products being applied at wrong locations, causing damage to waterways, and the like.

BRIEF SUMMARY

The current disclosure provides an enhancement to conventional systems, at least in part by introducing a novel system and method for automatically detecting overrun or underrun errors when crossing work area boundaries (interior or exterior) during operation of a work machine. Such error detection may for example be based on boundaries or coverage, implement height signal, section on/off state signal, depth of tillage, nozzle on/off status of a sprayer, and/or the like. Further advantages over conventional systems and methods may relate to real time correction of lookahead times based on error feedback, and persisting of such corrections for reuse of the learned lookahead times.

The disclosed approach can be used to control raising and/or lowering of the work implement, and/or an on/off time of the work implement or section. For example, a work implement may be lowered before any section needs to be controlled on and the work implement may only be raised after all the sections are turned off.

According to a first embodiment as disclosed herein, a method is provided for automated self-correction of lookahead delay for working intermissions associated with a work machine comprising at least one work implement. During traverse by the work machine of a work area, one or more working conditions are determined and a command generated to at least one actuator corresponding to a working intermission for an associated work implement or component thereof, wherein the generated command accounts for an estimated delay between initiation of the command and execution of at least part of the working intermission. An error value is ascertained based on a determined actual delay with respect to the estimated delay, and a modified delay is stored based on the ascertained error value as the estimated delay for subsequent working intermissions at least with respect to the determined one or more working conditions.

In an exemplary aspect according to the above-referenced embodiment, the generated command may comprise a first generated command accounting for a corresponding estimated delay with respect to a start of the working intermission.

A second command may be generated accounting for a corresponding estimated delay with respect to an end of the working intermission.

In other exemplary aspects according to the above-referenced embodiment, optionally further in view of one or more other aspects, the estimated delay may be based on a distance to a start of the working intermission, and/or a distance to an end of the working intermission, and/or a time to a start of the working intermission, and/or a time to an end of the working intermission.

In another exemplary aspect according to the above-referenced embodiment, optionally further in view of one or more other aspects, the generated command may comprise one or more respective control signals for raising/lowering the work implement or component thereof in association with a start of the working intermission, and lowering/raising the work implement or component thereof in association with an end of the working intermission.

In another exemplary aspect according to the above-referenced embodiment, optionally further in view of one or more other aspects, the generated command may comprise one or more respective control signals for suspending operation of the work implement or component thereof in association with a start of the working intermission, and restoring operation of the work implement or component thereof in association with an end of the working intermission.

In another exemplary aspect according to the above-referenced embodiment, optionally further in view of one or more other aspects, the determined one or more working conditions may comprise one or more of current ambient conditions, a work machine configuration, and one or more sensed work area conditions.

In another exemplary aspect according to the above-referenced embodiment, optionally further in view of one or more other aspects, the method may comprise iterative generation of an algorithm in data storage which correlates inputs comprising initiation of working intermission commands and associated sets of work conditions with respect to outputs comprising determined actual delays, wherein an estimated delay for a current working intermission is determined by reference to the algorithm, and wherein a determined actual delay after the current working intermission is provided as feedback for continued development of the algorithm in the data storage.

In another exemplary aspect according to the above-referenced embodiment, optionally further in view of one or more other aspects, initial estimated delays may be manually provided via a user interface in association with initial working intermissions, and wherein automatic generation of the estimated delays is implemented upon selection of an automatic mode and subsequent to predicted estimated delays with respect to determined actual delays satisfying a specified figure of merit for the algorithm.

In another embodiment as disclosed herein, a work machine includes a work vehicle having at least one work implement mounted thereon or towed thereby, and a controller configured to direct the performance of a method according to the above-referenced embodiment and optionally one or more of the referenced aspects thereof.

Numerous objects, features and advantages of the embodiments set forth herein will be readily apparent to those skilled in the art upon reading of the following disclosure when taken in conjunction with the accompanying drawings.

DETAILED DESCRIPTION

With reference herein to the representative figures, various embodiments may now be described of an inventive system and method.

Figure 1:
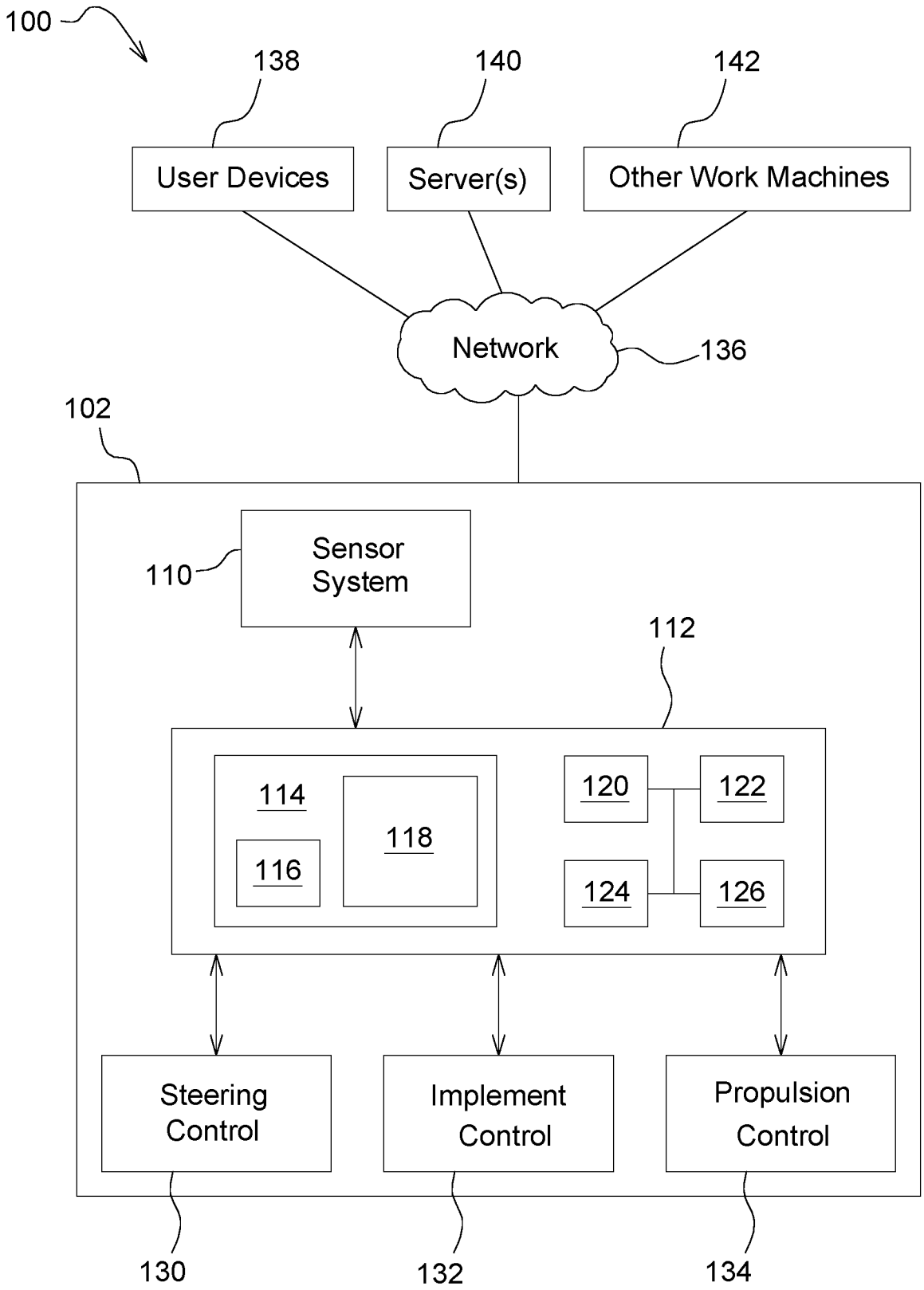
FIG. 1 is a block diagram representing a system according to an embodiment of the present disclosure.

FIG. 1 in a particular embodiment as disclosed herein shows a system 100 for automatic delay compensation of working intermissions for a work machine 102. As further represented in FIGS. 2-4 and described below, the work machine 102 may include a work vehicle 104 towing, pushing, or otherwise having integrated therewith one or more work implements 106 for use in a work area. A work implement 106 may for example be configured to physically engage, spray, or otherwise work terrain, crops, or other features as may be appreciated by one of skill in the art, depending on the desired operation and work area.

The exemplary system 100 of FIG. 1 includes a sensor system 110 coupled or otherwise functionally linked to a controller 112 including a user interface 114. In turn, the controller 112 may have integrated therein or otherwise communicate with a steering control unit 130, an implement control unit 132, and/or a propulsion (e.g., engine speed) control unit 134. Such control units and respective functions, among others, may be discrete in nature or otherwise combined in various embodiments without departing in any way from the scope of the present disclosure.

The controller 112 may generate output signals corresponding to display and/or automatic control of various operations of the work machine 102 consistent with a working intermission, based for example on an interior or exterior boundary that is not to be worked by the work machine 102 and associated work implement(s) 106. Exemplary boundaries may be associated with an obstacle, obstruction, hazard, safety condition, or another condition that requires the work machine 102 to raise and/or lower the one or more work implements 106, turn on/off relevant sections thereof, or even depart from the planned path, stop movement, or take evasive measures which may generally represent a planned or unplanned intermission in an otherwise planned or desired working operation.

The controller 112 may generate control signals for any or all of the steering control unit 130, the implement control unit 132, and/or the propulsion control unit 134, and/or any other component or system that is/are consistent with work machine operations and working intermissions, and subject to modification or interruption by the system 100 or another system. For example, control signals may comprise a steering control signal or data message that defines a steering angle of the steering shaft, a braking control signal or data message that defines the amount of deceleration, hydraulic pressure, or braking friction to the applied to brakes, a propulsion control signal or data message that controls a throttle setting, a fuel flow, a fuel injection system, vehicular speed or vehicular acceleration. Further, where a work vehicle 104 of the work machine 102 may be propelled by an electric drive or electric motor, the propulsion control signal may control or modulate electrical energy, electrical current, electrical voltage provided to an electric drive or motor. The control signals generally vary with time as necessary to track the path plan. The lines that interconnect the components of the system 100 may comprise logical communication paths, physical communication paths, or both. Logical communication paths may comprise communications or links between software modules, instructions or data, whereas physical communication paths may comprise transmission lines, data buses, or communication channels, to name non-limiting examples.

The steering control unit 130 may comprise or otherwise interact with an electrically controlled hydraulic steering system, an electrically driven rack and pinion steering, an Ackerman steering system, or another steering system. The propulsion control unit 134 may comprise or otherwise interact with an internal combustion engine, an internal combustion engine-electric hybrid system, an electric drive system, or the like.

The sensor system 110 may for example comprise a position determining system and/or an obstacle detection system which individually or collectively include one or more of global positioning system (GPS) sensors, vehicle speed sensors, ultrasonic sensors, laser scanners, radar wave transmitters and receivers, thermal sensors, imaging devices, structured light sensors, and other optical sensors, wherein exemplary imaging devices may include a digital (CCD/CMOS) camera, an infrared camera, a stereoscopic camera, a time-of-flight/depth sensing camera, high resolution light detection and ranging (LiDAR) scanners, radar detectors, laser scanners, and the like within the scope of the present disclosure.

The controller 112 may be configured to produce outputs, as further described below, to a user interface 114 associated with a display unit 118 for display to the human operator. The controller 112 may be configured additionally or in the alternative to produce outputs to a display unit independent of the user interface 114 such as for example a mobile user device 138 associated with the operator, a display unit functionally linked to one or more remote servers 140, one or more other work machines 142, etc. The controller 112 may be configured to receive inputs from the user interface 114, such as user input provided via the user interface 114. The controller 112 may in some embodiments further receive inputs from the remote user devices 138, servers 140, and/or other work machines 142 via respective user interface, for example a display unit with touchscreen interface. Data transmission between, for example, the controller 112 and a remote user interface may take the form of a wireless communications network 136 and associated components as are conventionally known in the art.

The controller 112 may for example include or be associated with a processor 120, a computer readable medium 122, a communication unit 124, data storage 126 such as for example may include a database network, and the aforementioned user interface 114 (for example as part of an onboard vehicle control panel or otherwise discretely disposed) having a display unit 118. An input/output device 116, such as a keyboard, joystick, touch screen, or other user interface tool, may be provided so that a human operator may input instructions to the controller 112. It may be understood that the controller 112 described herein may be a single controller having all of the described functionality, such as for example being part of a central vehicle control unit, or it may include multiple controllers wherein the described functionality is distributed among the multiple controllers.

Various operations, steps or algorithms as described in connection with the controller 112 can be embodied directly in hardware, in a computer program product such as a software module executed by the processor 120, or in a combination of the two. The computer program product can reside in RAM memory, flash memory, ROM memory, EPROM memory, EEPROM memory, registers, hard disk, a removable disk, or any other form of computer-readable medium 122 known in the art. An exemplary computer-readable medium can be coupled to the processor such that the processor can read information from, and write information to, the memory/storage medium. In the alternative, the medium can be integral to the processor. The processor and the medium can reside in an application specific integrated circuit (ASIC). The ASIC can reside in a user terminal. In the alternative, the processor and the medium can reside as discrete components in a user terminal.

The term "processor" 120 as used herein may refer to at least general-purpose or specific-purpose processing devices and/or logic as may be understood by one of skill in the art, including but not limited to a microprocessor, a microcontroller, a state machine, and the like. A processor can also be implemented as a combination of computing devices, e.g., a combination of a DSP and a microprocessor, a plurality of microprocessors, one or more microprocessors in conjunction with a DSP core, or any other such configuration.

The communication unit 124 may support or provide communications between the controller 112 and external systems or devices, and/or support or provide communication interface with respect to internal components of the work machine 102. The communications unit may include wireless communication system components (e.g., via cellular modem, WiFi, Bluetooth or the like) and/or may include one or more wired communications terminals such as universal serial bus ports.

The data storage 126 in an embodiment may for example be configured to receive and retrievably store delay errors, corrected delays, and corresponding parameters associated with the same for controlling work implements 106 and/or associated sections in a working intermission. Stored values may further include real-time and/or historical data sets regarding work machine parameters, generated work plans, work area/field boundary parameters, and the like in selectively retrievable form, for example as inputs for developing models as may be used for controlling work machine operations during or otherwise associated with working intermissions based on future input data sets. Data storage as discussed herein may, unless otherwise stated, generally encompass hardware such as volatile or non-volatile storage devices, drives, memory, or other storage media, as well as one or more databases residing thereon.

Figure 2:
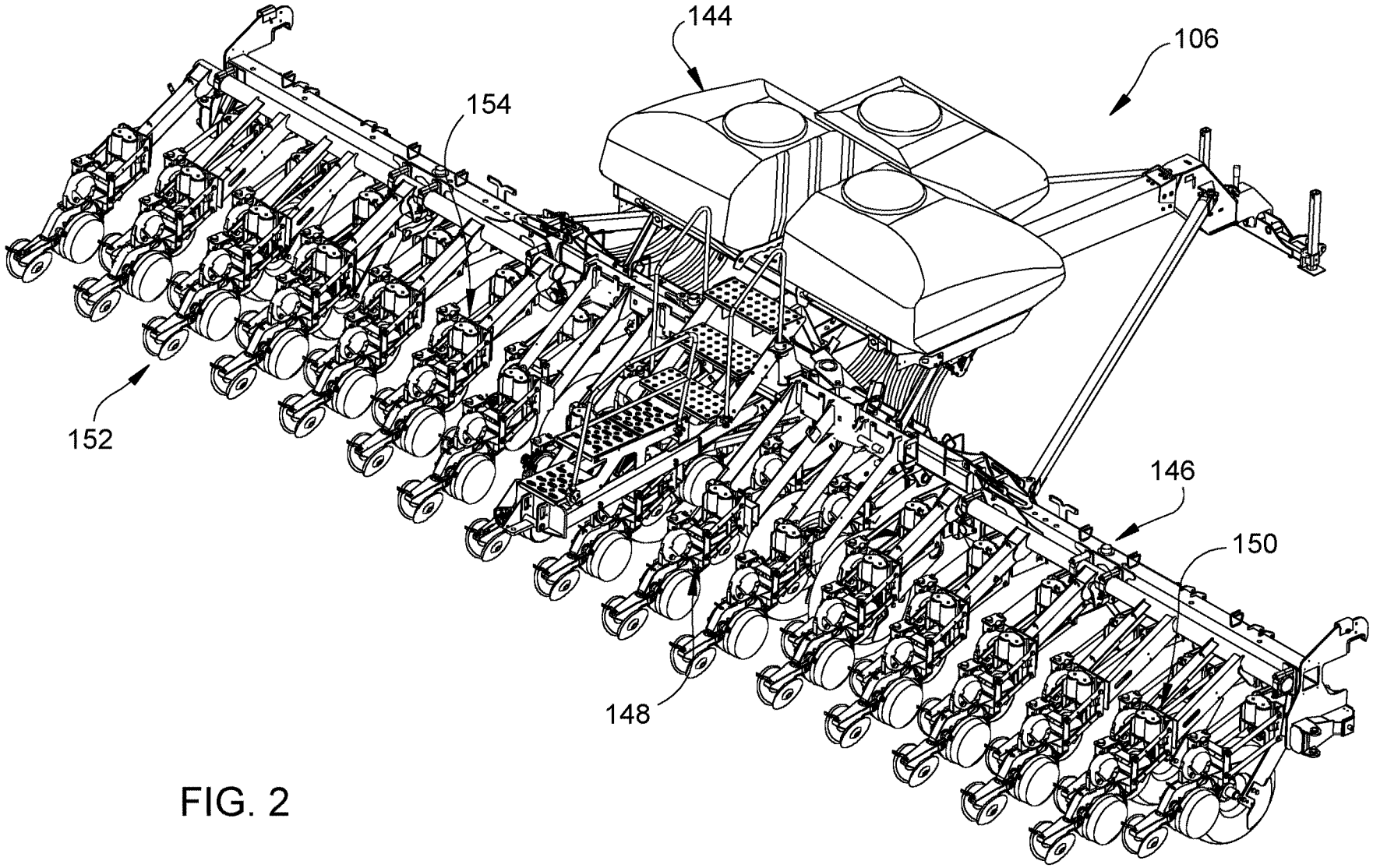
FIG. 2 is a perspective view of an exemplary work implement according to an embodiment of the present disclosure.

Referring to FIG. 2, an exemplary work implement 106 within the scope of the present disclosure may be a seeder implement comprising a single row seeder unit, or simply row unit, which may be attached, via for example a tow bar (not shown), to be towed behind a work vehicle 104, such as a tractor, during a seeding operation in a field. The work implement 106 may be configured to deliver a commodity (e.g., seed fertilizer, and/or other particulate or granular commodity) stored in one or more containers 144 to the work area (field) being traversed by the work machine 100.

The work implement 106 can comprise a movable frame 148, which is configured to move (e.g., up and down) during operation, that can be operably coupled to a stationary frame 146 by a linkage 150. In some implementations, the linkage 150 can comprise a four-bar linkage that can be used to keep the movable frame 148 substantially parallel to the stationary frame 146 as it moves up and down.

The work implement 106 may comprise one or more actuators 154 configured to adjust the downward force of the ground working tools 152 against the soil. To increase the downward force in excess of the row unit weight, or to be able to adjust the force, hydraulic and/or pneumatic actuators (and/or one or more springs) can be added to urge the ground working tools 152 downwardly with a controllable force. The one or more actuators 154 may also be used to lift the ground working tools 152 off the ground for transport or to maintain seed depth by adjusting downforce to account for variations in soil density.

Figure 3:
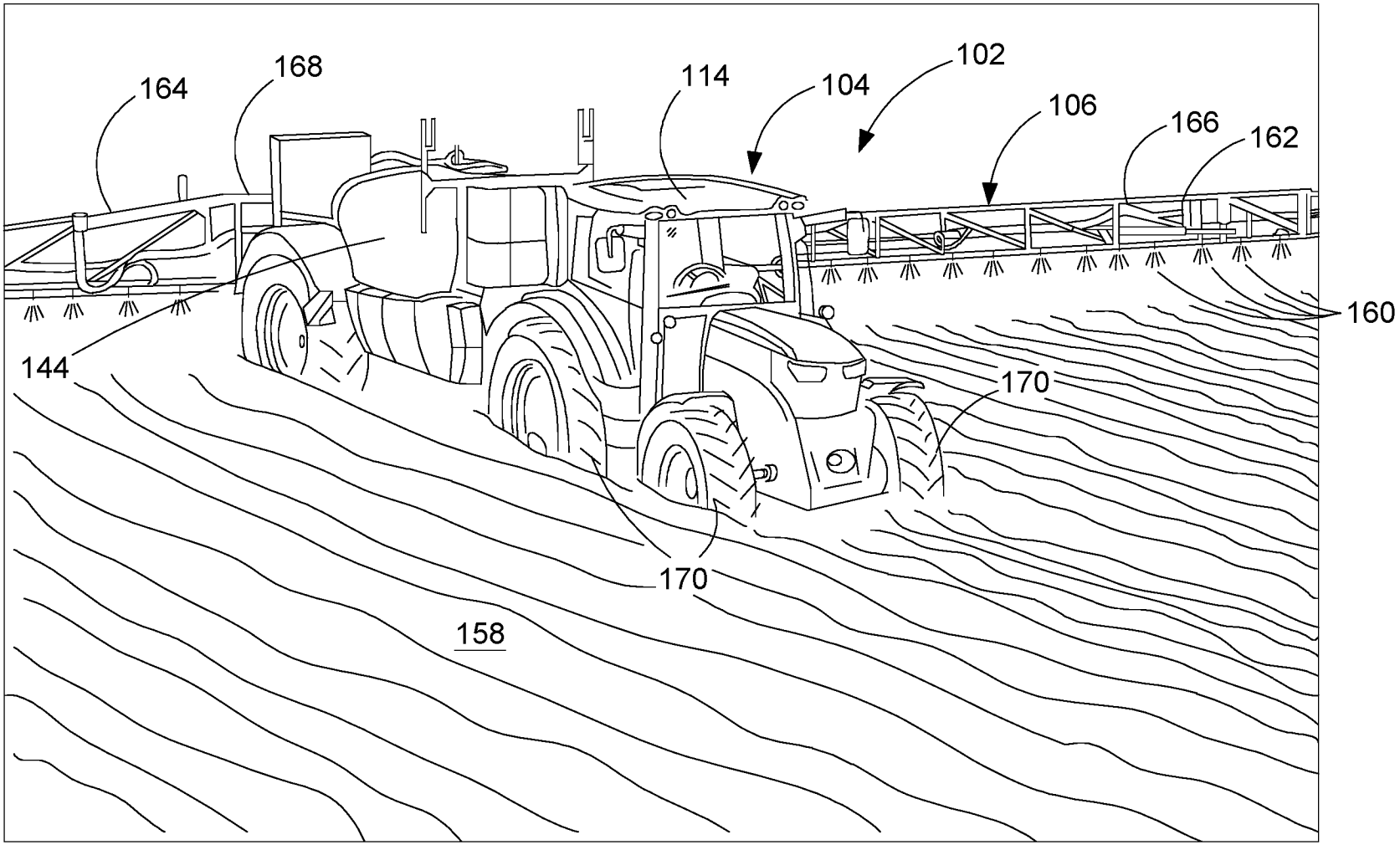
FIG. 3 is a perspective view of a work machine pulling another exemplary work implement according to an embodiment of the present disclosure.

FIG. 3 illustrates another example of a work machine 102, in the form of a sprayer or spraying machine. The work machine 102 includes a work implement as or otherwise carrying a spraying system, having a tank as container 144 containing a liquid that is to be applied to the work area (field) 216 being traversed. The tank 144 is fluidically coupled to spray nozzles 160 by a delivery system comprising a set of conduits. A fluid pump is configured to pump the liquid from the tank 144 through the conduits through spray nozzles 160. Spray nozzles 160 are coupled to, and spaced apart along, a boom 162. The boom 162 includes arms 164 and 166 which can articulate or pivot relative to a center frame 168. Thus, the arms 164 and 166 are movable between, e.g., a storage or transport position and an extended or deployed position.

In the example illustrated in FIG. 3, the work machine 102 comprises a towed work implement 106 that carries the spraying system, and is towed by a work vehicle 104 having an operator compartment or cab within which user interface 114 may be provided. The work machine 102 includes a set of ground-engaging units 170 for traversal of the ground surface 158, such as wheels, tracks, or other traction elements as are known in the art. In other embodiments, the work implement 106 or relevant components thereof may be self-propelled without a towing work vehicle 104, wherein for example the spraying system also includes propulsion and steering systems.

Figure 4:
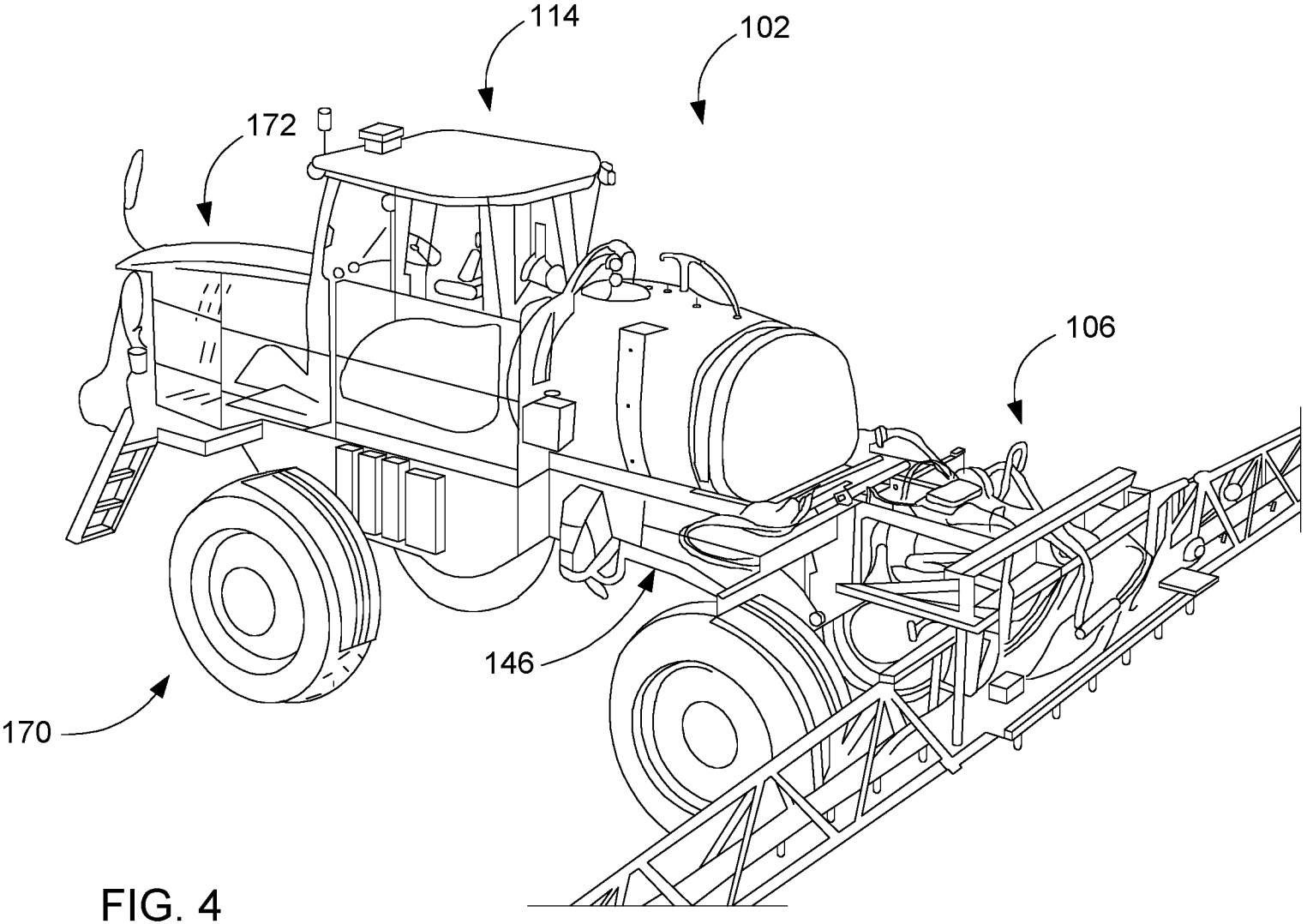
FIG. 4 is a perspective view of a work machine having a front-mounted work implement mounted thereto according to an embodiment of the present disclosure.

FIG. 4 illustrates one example of an agricultural spraying work machine 102 that is self-propelled. The work machine 102 has an on-board spraying system as the work implement 106, that is carried on a machine frame 146 having an operator compartment within which a user interface 114 may be provided, ground-engaging units 170 (e.g., wheels or other traction elements), and a propulsion system 172 (e.g., internal combustion engine).

Figure 5:
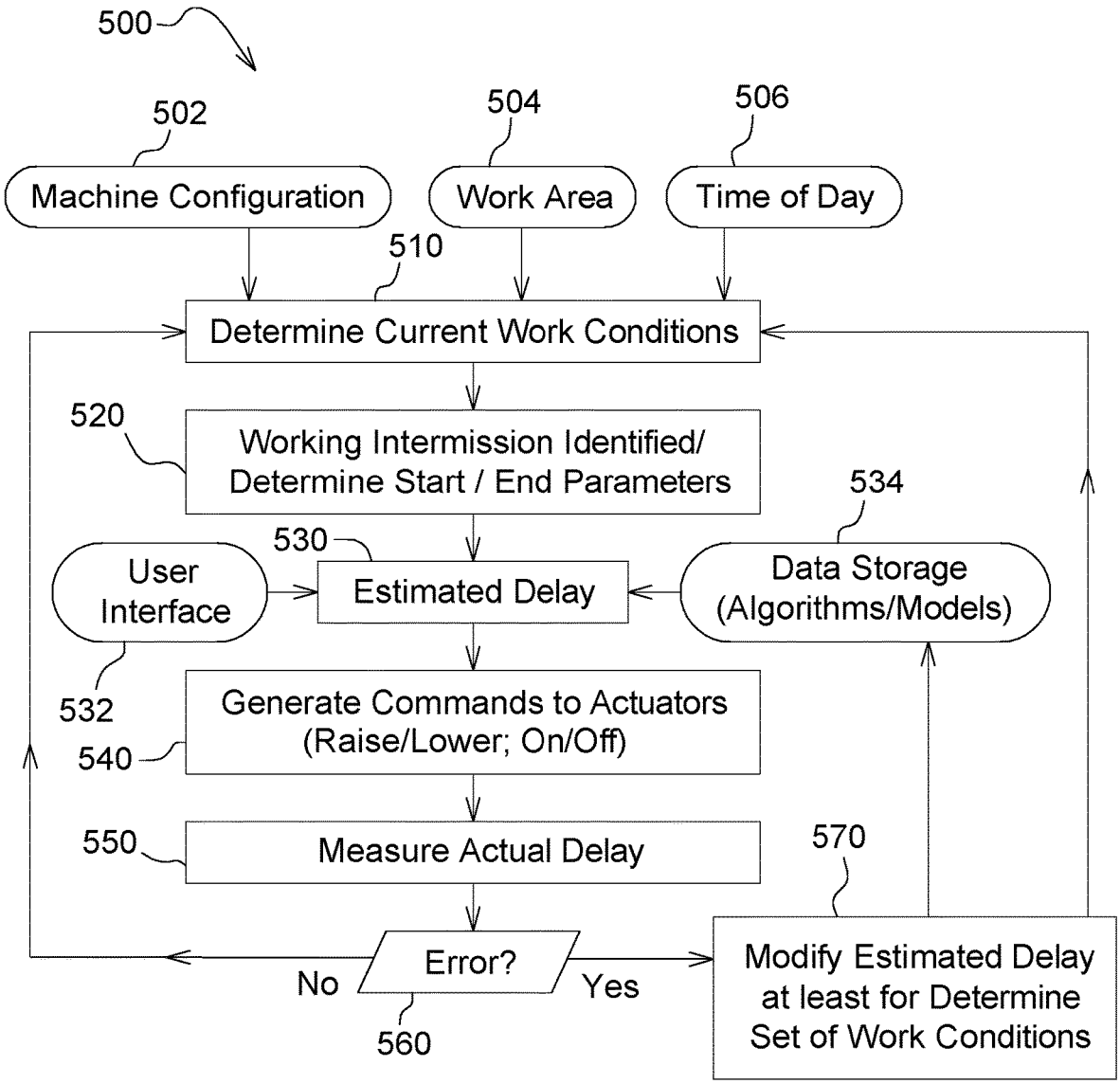
FIG. 5 is a flowchart representing an exemplary method according to an embodiment of the present disclosure.
Figure 6:
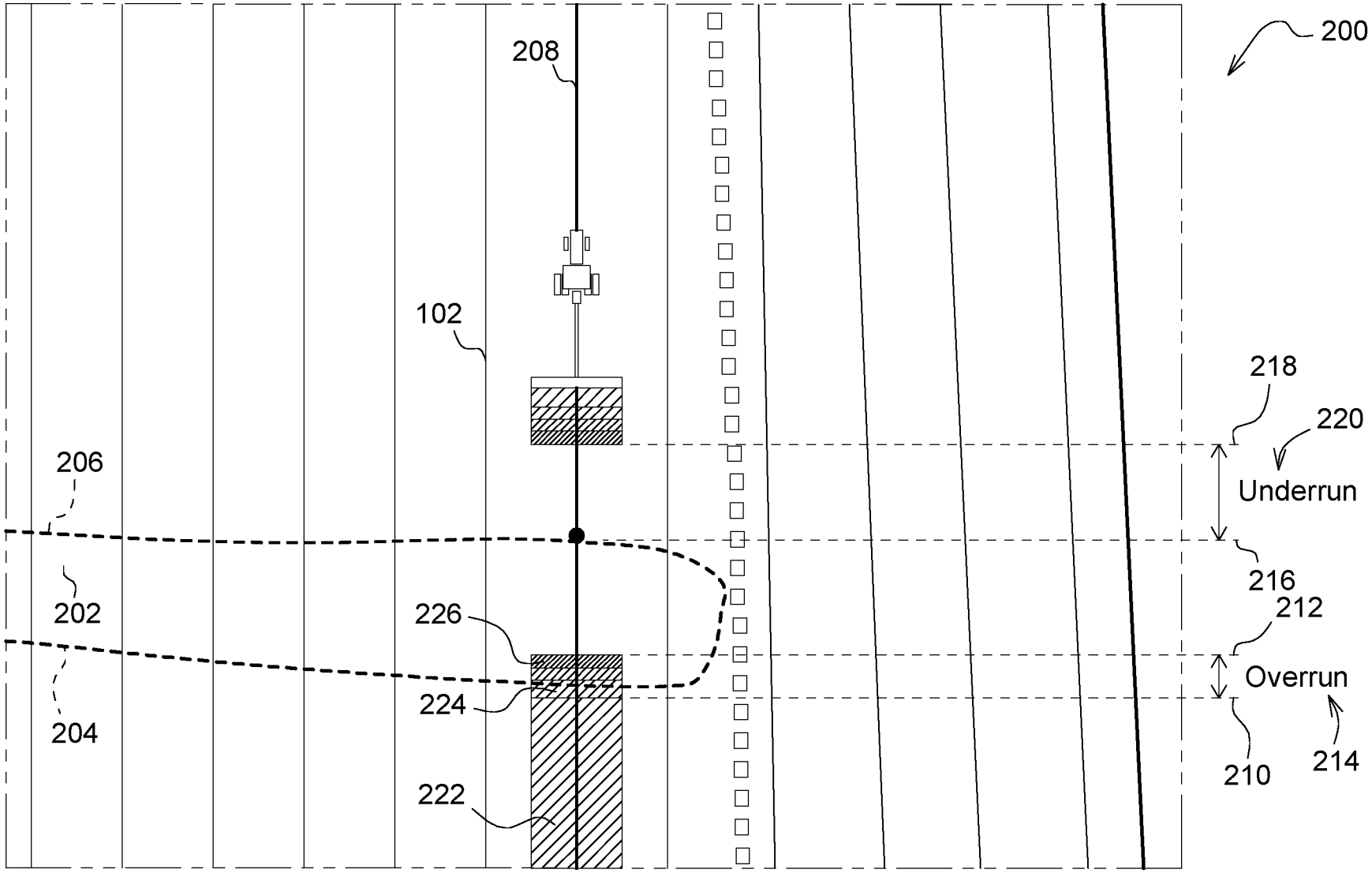
FIG. 6-8 are graphical diagrams representing a user interface with an overhead view of an exemplary work area including interior boundaries and overrun/underrun resulting from various examples of intermission delays.
Figure 7:
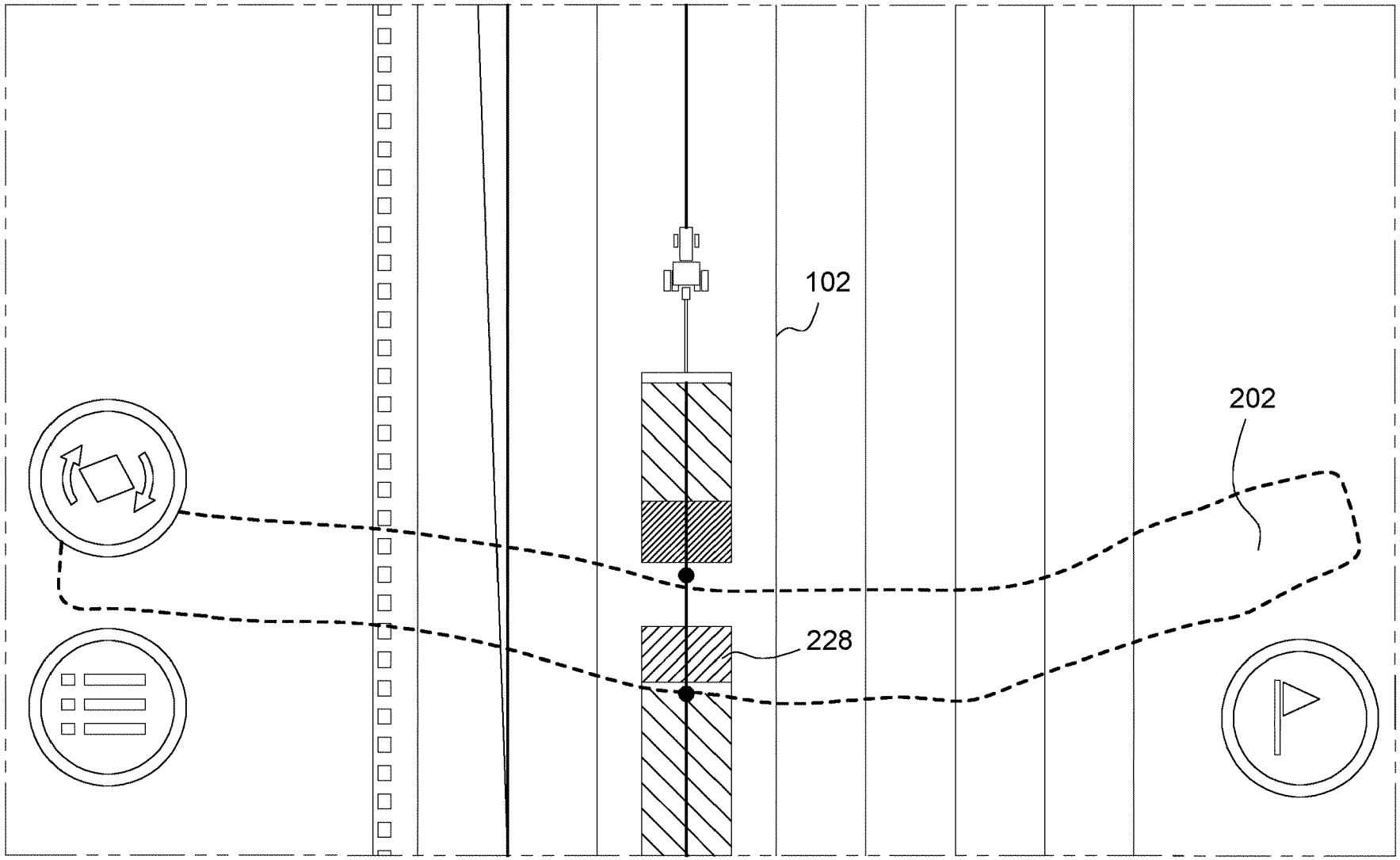
Figure 8:
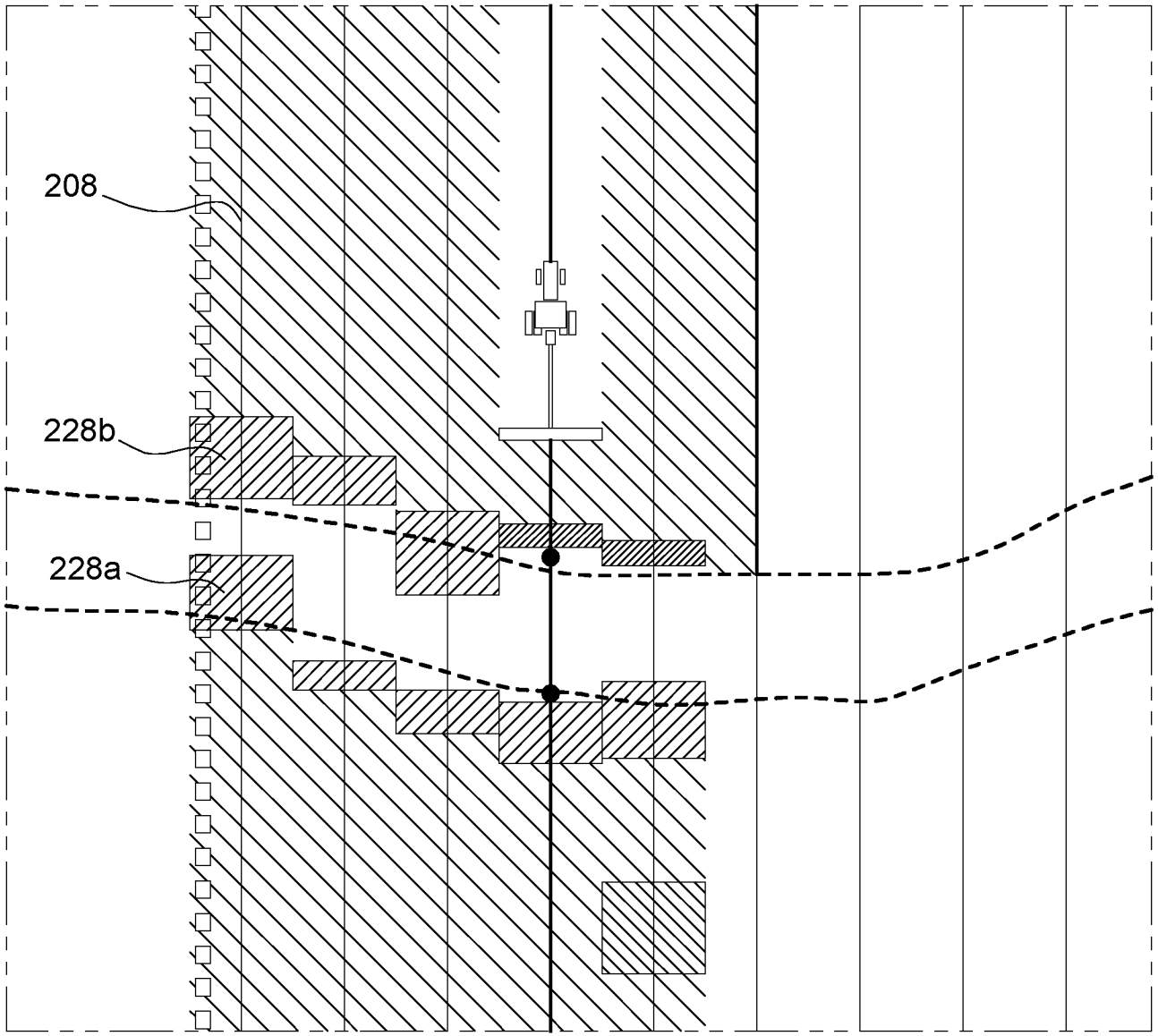

Referring now to FIG. 5, and to FIGS. 6-8 for further illustration, an embodiment of a method 500 according to the present disclosure may be described.

For illustrative purposes, but not limiting on the scope of the systems and methods disclosed herein unless otherwise specifically noted, FIG. 5 will be described in the context of a system 100, work machine 102, work vehicle 104, work implement 106, and the like as illustrated in FIGS. 1-4.

While the illustrated embodiment may include a specific arrangement of steps, inputs, outputs, and the like, it may be understood that certain steps may be combined, performed in a different order, or even omitted altogether in other embodiments within the scope of the present disclosure, unless otherwise specifically noted herein.

The method 500 may include determining current work conditions (step 510) in a work operation for the work machine, for example based on inputs received from data sources comprising the sensor system 110, machine control system, user interface 114, remote user devices 138, servers 140 such as hosted servers or third party servers, other work machines 142, and the like. Exemplary work conditions may include machine configuration or operating parameters 502, work area conditions 504, ambient/environmental conditions 506, etc.

Ambient conditions to be considered may include relevant factors with respect to mechanical delay for a particular application or type of work machine/implement, for example the temperature in an environment may affect hydraulic fluid density and thus the time needed to raise or lower the work implement. In various embodiments, such ambient conditions may be sensed as direct inputs, or alternatively may be indirectly accounted for, for example through monitoring of coverage and automatically determining an associated variation or error attributable to conditions. In various embodiments, one or more ambient conditions may be indirectly determined or predicted based on a date, time of day, etc., or further using inputs from external data sources such as for example third party weather service platforms.

Work area conditions 504 may be defined via user input, sensed in real time using one or more sensors in the sensor system 110, retrieved from data storage based on previously surveyed and/or mapped work area data, plans, and the like. The user interface 114 may be configured to receive the user input for defining a work area such as for example including exterior field boundaries and interior headland boundaries and regions, wherein additional interior regions may be determined based on real time conditions such as for example a newly detected obstacle, a larger or smaller waterway than expected, etc., as well as in various embodiments prior coverage within the work area.

The method 500 may include identifying an upcoming working intermission, and determining start and/or end parameters for the working intermission (step 520).

Referring to FIG. 6 for illustrative and exemplary context, a work machine 102 is operating within a work area, and traveling along path 208 which intersects a working intermission area 202 which is preferably not worked as part of the operation. The working intermission area 202 may for example be a waterway, a portion of the work area 200 that includes crops not to be treated or otherwise operated upon as part of the present operation, for example portions of the work area that have already been covered, etc., bounded with respect to the path 208 by entry 204 and exit 206. Accordingly, one or more exemplary start parameters for a working intermission of the work machine 102 may generally correspond to the entry 204 of the working intermission area 202, and one or more exemplary end parameters for the working intermission of the work machine 102 may generally correspond to the exit 206 of the working intermission area 202.

Start and end parameters for the working intermission of the work machine may for example relate to functions which are desirably performed or altered during the working intermission, which can vary depending on the type of work machine, the operation being performed, the type of work area and terrain being worked, the type of working intermission area, etc. For example, if a ground-engaging tool should be raised during the working intermission, the parameters may relate to actuators which must be engaged, settings for raising the ground-engaging tool, etc. The relevant parameters may be predetermined for any one or more of a particular type of work machine, operation being performed, work area and/or terrain being worked, working intermission area, and the like, or may be specified by manual user input, or may be learned over time using models which are trained to identify optimal parameters based on correlations between input data sets for the parameters and labeled outcomes (e.g., relating in part to errors during working intermissions).

FIG. 6 further represents an overrun 214 which may result from an intended implementation 210 of the working intermission, e.g., raising of a work implement or disabling one or more sections, being undesirably delayed until an actual implementation 212 of the working intermission which extends beyond the entry 204 of the working intermission area 202.

FIG. 6 further represents an underrun 220 which may result from an intended implementation 216 of the working intermission, e.g., raising of a work implement or disabling one or more sections, being undesirably delayed until an actual implementation 218 of the working intermission which extends beyond the exit 206 of the working intermission area 202.

In an embodiment, a user interface may be configured for representative display of the work area and the status of the working intermission relative to normal operation. For example, normal operation of the work machine 102 and the associated work implement or sections thereof may be indicated using a first indicia 222, which is hatched in the illustrated example but may alternatively be color coded or other equivalent indicia.

Additional indicia 224, 226 may be utilized to represent a working intermission for the work implement or sections thereof, and in some embodiments a plurality of indicia may indicate intermediate stages in which the work implement has been partially raised/lowered, partially reduced in flow, etc.

As further represented in an exemplary user interface according to FIG. 7, further or alternative indicia 228 may be provided to clearly indicate operation of the work implement or sections thereof during (after the identified entry 204 of) an identified working intermission.

As further represented in an exemplary user interface according to FIG. 8, one type or form of indicia **228*a* may be provided to clearly indicate operation of the work implement or sections thereof during (after the identified entry 204 of) an identified working intermission, while another type or form of indicia 228*b* may be provided to separately indicate a lack of operation of the work implement or sections thereof after the identified exit 206** of the working intermission.

A working intermission area 202, for example including the boundaries thereof, restricted operations or parameters for determining such restricted operations or priority thereof, etc., may in various embodiments be determined using user input via the user interface 114 or another user interface associated with devices or servers of or associated with system 100.

The working intermission area 202, for example including the boundaries thereof, restricted operations or parameters for determining such restricted operations or priority thereof, etc., may in various embodiments be predefined for a respective work area 200 based on mapped information retrievable and readable by the controller 112 of the work machine 102 during a given operation.

The working intermission area 202, for example including the boundaries thereof, restricted operations or parameters for determining such restricted operations or priority thereof, etc., may in various embodiments be downloaded or otherwise communicated to the work machine 102 from an external source based on alerts associated with the work area 200 and with knowledge that the work machine 102 is operating there within.

The working intermission area 202, for example including the boundaries thereof, restricted operations or parameters for determining such restricted operations or priority thereof, etc., may in various embodiments be determined automatically through input data received in real time via the sensor system 110 and classified according to trained models for identifying the need for a working intermission, based for example on labeled negative outcomes corresponding to identified features within the working intermission area 202.

The method 500 may include estimating one or more delays between initiation of commands to execute respective portions of the working intermission and actual execution of the respective portions of the working intermission (step 530). The estimated delay may for example be based on a distance to a start of the working intermission, and/or a distance to an end of the working intermission, and/or a time to a start of the working intermission, and/or a time to an end of the working intermission. In various embodiments, only a first estimated delay may be estimated and automatically implemented by the work machine for initiation of the working intermission, with responsibility for ending of the working intermission being assigned to the operator. In various embodiments, user-selectable control modes may be available, wherein estimated delays for either or both of the start and end of the working intermission may be manually or automatically assigned based on a selected control mode. For example, a default control mode may include automatic recognition of a working intermission, estimation of associated start and end delays, and execution of the start and end of the working intermission, whereas user-selectable control mode options enable manual settings for any one or more of the aforementioned features.

In various embodiments, an initial delay may be estimated for a portion of the working intermission based at least in part on user input (step 532). In various embodiments, the delay may be estimated based on input from data storage (step 534), corresponding to error corrections from prior iterations of the method, and/or based on predicted delay characteristics using algorithms/models developed over time using various input data sets corresponding to, e.g., the various available inputs 502, 504, 506 and trained to identify correlations between these inputs and actual observed delays. In such embodiments, an initial delay may still be manually provided for one or more iterations of an operation in the relevant work area or portion thereof, and then corrected and selectively replaced for later iterations based on predicted delay characteristics using a model that has been sufficiently trained and verified.

In an embodiment, algorithms/models may be iteratively generated over time and retrievably stored in data storage to correlate inputs comprising initiation of working intermission commands and associated sets of work conditions with respect to outputs comprising determined actual delays. An estimated delay for a current working intermission may be determined by reference to the algorithm, and a determined actual delay after the current working intermission is provided as feedback for continued development of the algorithm in the data storage. As previously noted, initial estimated delays may for example be manually provided via a user interface in association with initial working intermissions. Automatic generation of the estimated delays may in such embodiments be further implemented for example upon selection of an automatic mode and subsequent to predicted estimated delays with respect to determined actual delays satisfying a specified figure of merit for the algorithm, or other equivalent process for verification that the algorithm is sufficiently trained.

One of skill in the art may appreciate that delays in implementation of a working intermission (at either or both of the entry and/or exit therefrom) may stem from mechanical delay, electrical delay, or other pertinent delay sources. In various embodiments, delay data may be predefined and available for use, for example via one or more data structures that map different tools to different mechanical delay times. As one example, a planter that takes five seconds to lower into a planting site may indicate a mechanical delay of five seconds. As another example, a sprayer that takes half of one second to activate (e.g., to move a nozzle from a closed to an open position) would have an indication in the data structure of a mechanical delay of half of one second. In an embodiment, there may be many different mechanical delays (e.g., delays relating to raising or lowering a tool, delays relating to starting and stopping dispensing, etc.), and the delays in the aggregate may be accounted for in determining an initial delay time.

In various embodiments, the estimated delay may account for an estimated time until the entry and/or exit of the working intermission based at least in part on sensor data (e.g., speed, acceleration, yaw, etc.) corresponding to work machine operation. For example, determining that the work machine will reach an entry of the working intermission area at a particular time may include determining a speed and/or acceleration of the work machine, and calculating, based on the speed and/or acceleration of the work machine, a point from which the work machine is the amount of time away from the entry of the working intermission. As another example, where a curved trajectory exists between a current position of the work machine and the entry of the working intermission, determining that the work machine will reach the entry of the working intermission in the amount of time further may include determining and accounting for a yaw of the curve.

The method 500 may include generating commands to one or more actuators associated with the work machine, and more particularly in most contexts associated with the work implement or sections thereof, to execute the working intermission in accordance with the estimated delay, or otherwise stated to compensate for the estimated delay using for example a look ahead time or distance (step 540). In various embodiments, a first generated command may account for a corresponding estimated delay with respect to a start of the working intermission, and a second generated command accounting for a corresponding estimated delay with respect to an end of the working intermission.

In various embodiments, the generated commands may include respective control signals for raising/lowering the work implement or component thereof in association with a start of the working intermission, and lowering/raising the work implement or component thereof in association with an end of the working intermission. For example, a work implement may be lifted from a ground-engaging position in association with a desired working intermission to avoid damaging the terrain within the working intermission area, or damaging the work implement itself, depending on the type of work implement, work area, working intermission area, operation, or the like. Commands may be provided for raising and/or lowering of the entire work implement or a portion thereof, for example as pertaining to a tillage tool, planter, sprayer, combine header, or the like.

In various embodiments, the generated commands may include respective control signals for suspending operation of the work implement or component thereof in association with a start of the working intermission, and restoring operation of the work implement or component thereof in association with an end of the working intermission. For example, one or more sprayers, seed planters, or the like may be selectively disabled during operations corresponding with the working intermission area to avoid treating undesired portions of the work area. It may be appreciated that in some contexts a work implement such as an array of work implement components may only partially overlap a working intermission area during operation, wherein only a subset of the relevant components need to be disabled in correspondence with the working intermission and others of the relevant components may be able to continue operating normally.

In various embodiments, the generated commands may include a combination of commands for raising/lowering of the work implement and commands for turning on/off sections at the same time, or otherwise overlapping or in sequence during the same entry and/or end portion of a working intermission. For example, in an embodiment the work implement may preferably be lowered before any area treating section is controlled to be turned on, and the work implement may preferably be raised after all of the area treating sections have been controlled to be turned off.

The method 500 may include further automatically measuring or otherwise determining an actual delay, i.e., look ahead error, between initiation of the commands to the one or more actuators and actual execution of the commands (step 550). Actual delay and corresponding error determination may for example directly correspond to an overrun 214 and/or underrun 220 of the work implement or sections thereof and as illustrated in FIG. 6.

The actual delay and corresponding error determination may for example be measured based on a time and/or distance between an expected initiation of one or more functions associated with a command and an actual execution of the one or more functions associated with the command.

In various embodiments, actual delay and corresponding error determination may be based on sensed work implement height or depth signals, for example a depth of tillage.

In various embodiments, actual delay and corresponding error determination may be based on a section on/off state signal, for example representing a nozzle on/off status with respect to a spraying system.

If an error is not observed between the estimated delay and the actual delay (i.e., "no" in response to query in 560), the estimated delay is typically maintained at least with respect to the current set of work conditions 502, 504, 506.

If an error is observed between the estimated delay and the actual delay (i.e., "yes" in response to query in 560), the method 500 may further include modifying the estimated delay (step 570) at least with respect to the current set of work conditions 502, 504, 506, wherein the modified delay may be persisted in data storage for subsequent reuse with respect to a working intermission associated with the same or equivalent set of work conditions. The estimated delay, e.g., look ahead time, may be modified using a gain factor which is predetermined, user specified, automatically derived using algorithms or models trained for optimal error correction or otherwise as part of other models as described herein, etc.

The observed error, modified delay, and related data may be further provided as feedback for continued training and improvement of one or more associated algorithms and/or models as described herein.

As used herein, the phrase "one or more of," when used with a list of items, means that different combinations of one or more of the items may be used and only one of each item in the list may be needed. For example, "one or more of" item A, item B, and item C may include, for example, without limitation, item A or item A and item B. This example also may include item A, item B, and item C, or item B and item C.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

What is claimed is:

1. A method for automated self-correction of lookahead delay for working intermissions associated with a work machine comprising at least one work implement, the method comprising:

during traverse by the work machine of a work area, determining one or more working conditions and generating a command to at least one actuator corresponding to a working intermission for an associated work implement or component thereof, wherein the generated command accounts for an estimated delay between initiation of the command and execution of at least part of the working intermission, wherein the generated command comprises a combination of commands for raising or lowering the work implement and commands for turning on or off one or more sections of the work implement, wherein the work implement is lowered before any section is controlled to be turned on and raised after all sections are controlled to be turned off;

ascertaining an error value based on a sensed work implement height signal and a determined actual delay with respect to the estimated delay;

storing a modified delay based on the ascertained error value as the estimated delay for subsequent working intermissions at least with respect to the determined one or more working conditions; and automatically retrieving and applying the stored modified delay to a plurality of subsequent working intermissions upon determining one or more equivalent working conditions.

2. The method of claim 1, wherein the generated command comprises a first generated command accounting for a corresponding estimated delay with respect to a start of the working intermission.

3. The method of claim 2, comprising generating a second command accounting for a corresponding estimated delay with respect to an end of the working intermission.

4. The method of claim 1, wherein the estimated delay is based on a distance to a start of the working intermission and/or a distance to an end of the working intermission.

5. The method of claim 1, wherein the estimated delay is based on a time to a start of the working intermission and/or a time to an end of the working intermission.

6. The method of claim 1, wherein the generated command comprises one or more respective control signals for raising/lowering the work implement or component thereof in association with a start of the working intermission, and lowering/raising the work implement or component thereof in association with an end of the working intermission.

7. The method of claim 1, wherein the generated command comprises one or more respective control signals for suspending operation of the work implement or component thereof in association with a start of the working intermission, and restoring operation of the work implement or component thereof in association with an end of the working intermission.

8. The method of claim 1, wherein the determined one or more working conditions comprise one or more of ambient conditions, a work machine configuration, and one or more sensed work area conditions.

9. The method of claim 1, comprising iterative generation of an algorithm in data storage which correlates inputs comprising initiation of working intermission commands and associated sets of work conditions with respect to outputs comprising determined actual delays, wherein an estimated delay for a current working intermission is determined by reference to the algorithm, and wherein a determined actual delay after the current working intermission is provided as feedback for continued development of the algorithm in the data storage.

10. The method of claim 9, wherein initial estimated delays are manually provided via a user interface in association with initial working intermissions, and wherein automatic generation of the estimated delays is implemented upon selection of an automatic mode and subsequent to predicted estimated delays with respect to determined actual delays satisfying a specified figure of merit for the algorithm.

11. A work machine comprising:

a self-propelled work vehicle having at least one associated work implement; and a controller configured to:

determine one or more working conditions during traverse by the work machine of a work area;

generate a command to at least one actuator corresponding to a working intermission for the work implement or at least one component thereof, wherein the generated command accounts for an estimated delay between initiation of the command and execution of at least part of the working intermission, wherein the generated command comprises a combination of commands for raising or lowering the work implement and commands for turning on or off one or more sections of the work implement, wherein the work implement is lowered before any section is controlled to be turned on and raised after all sections are controlled to be turned off;

ascertain an error value based on a sensed work implement height signal and a determined actual delay with respect to the estimated delay; and store a modified delay based on the ascertained error value as the estimated delay for subsequent working intermissions at least with respect to the determined one or more working conditions; and automatically retrieve and apply the stored modified delay to a plurality of subsequent working intermissions upon determining one or more equivalent working conditions.

12. The work machine of claim 11, wherein the generated command comprises:

a first generated command accounting for a corresponding estimated delay with respect to a start of the working intermission; and a second command accounting for a corresponding estimated delay with respect to an end of the working intermission.

13. The work machine of claim 11, wherein the estimated delay is based on:

a distance to a start of the working intermission and/or a distance to an end of the working intermission; or a time to a start of the working intermission and/or a time to an end of the working intermission.

14. The work machine of claim 11, wherein the generated command comprises one or more respective control signals for:

raising/lowering the work implement or component thereof in association with a start of the working intermission, and lowering/raising the work implement or component thereof in association with an end of the working intermission; or suspending operation of the work implement or component thereof in association with a start of the working intermission, and restoring operation of the work implement or component thereof in association with an end of the working intermission.

15. The work machine of claim 11, wherein:

the data storage comprises an iteratively generated algorithm which correlates inputs comprising initiation of working intermission commands and associated sets of work conditions with respect to outputs comprising determined actual delays;

the controller is configured to determine an estimated delay for a current working intermission by reference to the algorithm, and provide a determined actual delay after the current working intermission as feedback for continued development of the algorithm in the data storage;

wherein the work machine comprises a user interface configured to enable manual input of initial estimated delays in association with initial working intermissions; and wherein automatic generation of the estimated delays is implemented upon selection of an automatic mode and subsequent to predicted estimated delays with respect to determined actual delays satisfying a specified figure of merit for the algorithm.

16. A system for automated self-correction of lookahead delay for working intermissions of at least one work implement associated with a work machine, the system comprising one or more processors in functional communication with the work machine and configured, during traverse by the work machine of a work area, to:

determine one or more working conditions;

generate a command, via a controller associated with the work machine, to at least one actuator corresponding to a working intermission for the work implement or at least one component thereof, wherein the generated command accounts for an estimated delay between initiation of the command and execution of at least part of the working intermission, wherein the generated command comprises a combination of commands for raising or lowering the work implement and commands for turning on or off one or more sections of the work implement, wherein the work implement is lowered before any section is controlled to be turned on and raised after all sections are controlled to be turned off;

ascertain an error value based on a sensed work implement height signal and a determined actual delay with respect to the estimated delay; and store a modified delay based on the ascertained error value as the estimated delay for subsequent working intermissions at least with respect to the determined one or more working conditions; and automatically retrieve and apply the stored modified delay to a plurality of subsequent working intermissions upon determining one or more equivalent working conditions.

17. The system of claim 16, wherein the generated command comprises:

a first generated command accounting for a corresponding estimated delay with respect to a start of the working intermission; and a second command accounting for a corresponding estimated delay with respect to an end of the working intermission.

18. The system of claim 16, wherein the estimated delay is based on:

a distance to a start of the working intermission and/or a distance to an end of the working intermission; or a time to a start of the working intermission and/or a time to an end of the working intermission.

19. The system of claim 16, wherein the generated command comprises one or more respective control signals for:

raising/lowering the work implement or component thereof in association with a start of the working intermission, and lowering/raising the work implement or component thereof in association with an end of the working intermission; or suspending operation of the work implement or component thereof in association with a start of the working intermission, and restoring operation of the work implement or component thereof in association with an end of the working intermission.

20. The system of claim 16, wherein:

the data storage comprises an iteratively generated algorithm which correlates inputs comprising initiation of working intermission commands and associated sets of work conditions with respect to outputs comprising determined actual delays;

the one or more processors are configured to determine an estimated delay for a current working intermission by reference to the algorithm, and provide a determined actual delay after the current working intermission as feedback for continued development of the algorithm in the data storage;

wherein the system comprises a user interface configured to enable manual input of initial estimated delays in association with initial working intermissions; and wherein automatic generation of the estimated delays is implemented upon selection of an automatic mode and subsequent to predicted estimated delays with respect to determined actual delays satisfying a specified figure of merit for the algorithm.

* * * * *